US006322464B1

(12) United States Patent
Sestak

(10) Patent No.: US 6,322,464 B1
(45) Date of Patent: Nov. 27, 2001

(54) HUNTING ARROWHEAD WITH BROADHEAD AND EXTENDABLE BLADES

(76) Inventor: Michael F. Sestak, 824 Fair Ave., Erie, PA (US) 16511

( * ) Notice: Subject to any disclaimer, the term of this patent is extended or adjusted under 35 U.S.C. 154(b) by 0 days.

(21) Appl. No.: 09/632,010

(22) Filed: Jul. 28, 2000

(51) Int. Cl.[7] ..... F42B 6/08
(52) U.S. Cl. ..... 473/583
(58) Field of Search ..... 473/578, 582, 473/583, 584, FOR 216, FOR 219, FOR 221, FOR 222

(56) References Cited

U.S. PATENT DOCUMENTS

| | | | | |
|---|---|---|---|---|
| 2,568,417 | | 9/1951 | Steinbacher . | |
| 3,036,395 | * | 5/1962 | Nelson . | |
| 3,578,328 | | 5/1971 | Rickey . | |
| 3,738,657 | | 6/1973 | Cox . | |
| 3,910,579 | | 10/1975 | Sprandel . | |
| 3,915,455 | | 10/1975 | Savora . | |
| 4,166,619 | * | 9/1979 | Bergmann et al. | 473/581 |
| 4,940,246 | * | 7/1990 | Stagg | 473/583 |
| 5,046,744 | | 9/1991 | Eddy . | |
| 5,078,407 | | 1/1992 | Carlston . | |
| 5,090,709 | | 2/1992 | Johnson . | |
| 5,100,143 | * | 3/1992 | Puckett | 473/583 |
| 5,172,916 | * | 12/1992 | Puckett | 473/583 |
| 5,458,341 | | 10/1995 | Forrest . | |
| 5,564,713 | * | 10/1996 | Mizek et al. | 473/583 |
| 5,820,498 | | 10/1998 | Maleski . | |
| 5,857,930 | * | 1/1999 | Troncoso | 473/583 |

* cited by examiner

*Primary Examiner*—John A. Ricci
(74) *Attorney, Agent, or Firm*—Kenneth W. Wargo

(57) ABSTRACT

A hunting arrowhead with a broadhead and extendable blades arrayed around a generally tubular main body with four equally-spaced longitudinal troughs. The broadhead blade is inserted into one opposed pair of troughs and secured in place, and an extendable L-shaped blade is pivotally secured within each of the other pair of opposed troughs, each such extendable blade held in place by a pivot pin allowing the blade to pivot about the distal end of the long leg. In a retracted position, the cutting edges of each extendable blade, located along the outside edge of the long leg, are housed within the corresponding trough, while the short leg extends outwardly from the arrowhead body nearest the forward or tip end of the body. A rubber band or O-ring holds the extendable blades in this retracted position. Upon impact with the target, the short legs feel the force of the impact and cause the extendable blade to quickly rotate into an open position, overcoming the resistance of the rubber-band or O-ring. As the extendable blades move into the open position, the previously housed cutting edges are exposed and provide a cutting surface perpendicular to the cutting surface of the broadhead blade. Blade stops on the extendable blades allow them to open to a certain point and no further. The tubular body is further provided with a threaded end which permits it to be attached or removed from the arrow shaft.

7 Claims, 3 Drawing Sheets

HUNTING ARROWHEAD WITH BROADHEAD AND EXTENDABLE BLADES

BACKGROUND OF THE INVENTION (a) Field of the Invention

This invention relates to arrowheads for use in archery hunting, more particularly to an arrowhead which combines a fixed broadhead blade with two cutting edges and a pair of pivoting extendable blades.

(b) Description of the Prior Art

Archery hunting has enjoyed an increased interest in recent years and this has been accompanied by innovations in equipment for use in archery. The two most important items of equipment for any archer are, of course, the bow and the arrow. A component of the arrow is the arrowhead, the most forward part of the arrow, attached to the shaft in some manner and generally including a sharpened point or cutting edges to allow the arrow to penetrate the target.

Since archery began in the distant past, it has been recognized that an effective arrowhead for hunting purposes must have a number of qualities. For one thing, a hunting arrowhead (combined with the arrow shaft and fletching) must provide for a stable and accurate flight so that the arrow can be accurately shot by the archer. A hunting arrowhead must also have good penetrating or cutting ability to allow it to enter the target. Finally, a hunting arrowhead must have good holding power to prevent it from coming too easily loose from the target.

Formerly, all arrows had arrowheads with one or more fixed blades. These could be broadly categorized as "field points" or "broadheads". A field point, used more for target archery than hunting, is a pointed, conical-shaped tip of various configurations where the widest diameter is equal to or less than the diameter of the arrow shaft, thereby showing no profile outside the arrowshaft as it would be viewed head-on in flight. Field points are not favored for hunting because their small penetrating cross-section provides limited cutting action.

Fixed broadhead blades are better for hunting. They are wide and flat, extending outside the diameter of the shaft of the arrow with razor sharp or knife cutting edges. These broadhead blades can extend well beyond the diameter of the arrow shaft and are typically shaped as triangles or pyramids, tapering wider as they extend toward the back end of the arrow. Various configurations of broadhead fixed blades are available, including arrowheads with two, three, four or more cutting edges. Fixed blade arrowheads with broadheads have exhibited a number of drawbacks. They are sometimes erratic in flight because of the aerodynamic properties of the broadhead blade surfaces. The cutting ability of such blades is also sometimes limited so that the arrow is deflected, or results in only a minor wound to the animal being hunted.

In an attempt to overcome the limitations of strictly fixed broadhead blade arrowheads, the prior art discloses arrowheads which include pivoted, movable blades. These movable blade devices are of various types, but generally they include two or more movable or expandable blades which are held in a retracted position tight to the arrowhead body while the arrow is in flight, and then moved into an open position when the arrow impacts with the target. Various United States patents have been issued for arrowheads with moveable blades. Some examples are: Steinbacher, U.S. Pat. No. 2,568,417; Rickey, U.S. Pat. No. 3,578,328; Cox, U.S. Pat. No. 3,738,657; Sprandel, U.S. Pat. No. 3,910,579; Savora, U.S. Pat. No. 3,915,455; Eddy, U.S. Pat. No. 5,046,744; Carlston, U.S. Pat. No. 5,078,407; Johnson, U.S. Pat. No. 5,090,709; Forrest, U.S. Pat. No. 5,458,341 and Maleski, U.S. Pat. No. 5,820,498.

The prior art discloses arrowheads with moveable blades in combination with field point type tips, for example, Maleski and Forrest, or limited fixed broadhead blades, with field point or "chisel" type tips, for example Johnson. Applicant is not aware of any prior art arrowheads combining moveable blades with a pure, fixed broadhead sharpened to or near the tip of the blade except for Stagg, U.S. Pat. No. 4, 940,246. While Stagg does disclose a combination of a fixed broadhead blade and a pair of opposed extendable blades, there are significant differences between the Stagg design and the Applicant's design.

SUMMARY OF THE INVENTION

The invention relates to an arrowhead which includes a single broadhead with two cutting edges and a pair of opposing, pivoting, extendable blades. The arrowhead includes a generally tubular main body with attachment means for securing it to the head end of an arrow shaft. A flattened, generally triangle-shaped broadhead blade with two cutting edges is removably attached to the body. The broadhead blade is opened in its center to provide venting to reduce weight and to present less blade surface area to reduce any unwanted aerodynamic characteristics. A pair of opposed, generally L-shaped extendable blades are pivotally attached to the body in a radial plane which transects the plane of the broadhead blade. The cutting edge on these extendable blades is located on the outside edge of the long legs of the "L". When the extendable blades are in a retracted position, their cutting edges are concealed within troughs in the main body and the short legs of the "L" protrude from the arrowhead body, roughly perpendicular to the flat surface of the broadhead. The extendable blades are held in the retracted position by means of a small rubber band or O-ring. Upon impact, the protruding short legs of the extendable blades come in contact with the target. The force of this impact is transmitted by pivoting action and the resistance provided by the rubber band is overcome. The extendable blades are forced into an open position, bringing their cutting surfaces into contact with the target. Stops on the ends of the long legs provide a maximum opening for the extendable blades.

Thus described, it should be evident to those skilled in the art that the invention has several objects and advantages. It is an object of the invention to provide an arrowhead for archery hunting which includes both a fixed broadhead blade and extendable blades. It is a further object of the invention to combine the best features of arrowheads with fixed broadhead blades and arrowheads with exptendable blades. It is yet another object of the invention to provide an arrow which is accurate in flight and yet has excellent cutting and holding power for game hunting. It is another object of the invention to disclose an arrowhead in which the broadhead blade can be removed and replaced in case it becomes damaged or nicked.

DESCRIPTION OF THE PREFERRED EMBODIMENT

Figure 1:
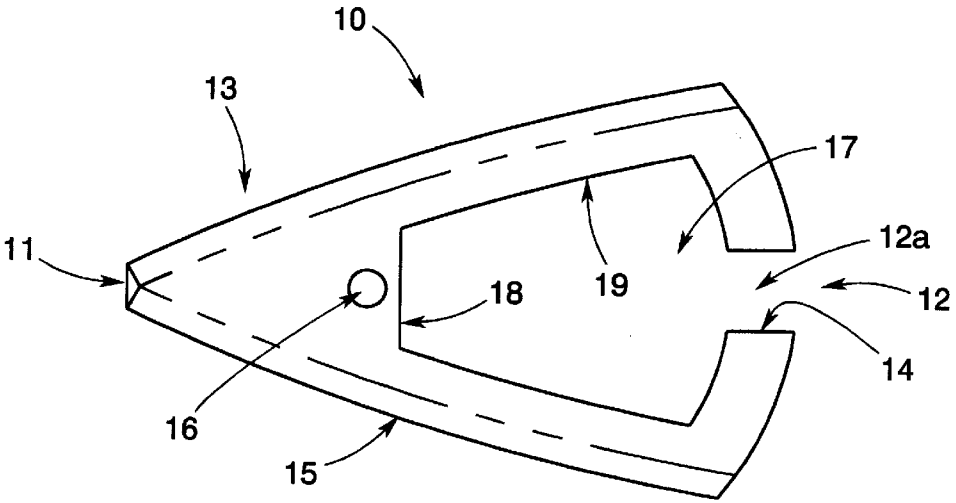
FIG. 1 is a side view of the broadhead blade of the invention.

Beginning with FIG. 1, the invention includes a broadhead blade 10. The broadhead blade 10 is flattened and shaped somewhat like an isosceles triangle, with slightly convex sides and a more pronounced convex curved base. It can be made of any suitable material, although in the preferred embodiment it would be made of stainless steel. The broadhead blade 10 includes a tip end 11, corresponding to the vertex of the sides, and a following end 12, corresponding to the base. In the drawings, tip end 11 is shown as slightly flattened, although it could also be pointed as well. The following end 12 is not continuous, but rather gapped near its center, forming following end gap 12*a*, for reasons which will be explained. Blade sides 13 run from the tip end 11 to the following end 12, terminating in following tabs 14 separated by the end gap 12*a* referred to previously. A razor or knife edge 15 extends along each of the two sides 13 from the tip 11 to the following end 12. Edges 15 could also be serrated.

A securing screw hole 16 is included in the broadhead blade 10 nearer the tip end 11. The broadhead blade 10 includes a blade opening 17 in its interior and extending through the following tabs 14. The blade opening 17 includes a flat 18 which defines the most forward edge of the opening 17 Interior sides 19 define the edges of the blade opening 17 opposite the sides 13. Blade opening 17 assists with the aerodynamics of the invention as will be explained below.

Figure 2:
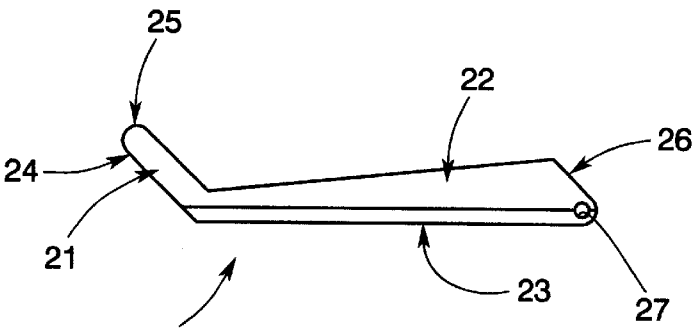
FIG. 2 is a side view of the extendable blade of the invention.
Figure 4B:
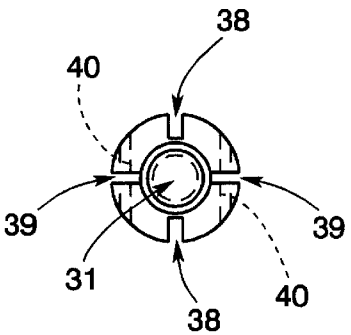
FIG. 4*b* is a sectional end view of the arrowhead body rotated 90° from FIG. 3*a*.

The invention further includes a pair of pivoting extendable blades. One such extendable blade is shown in FIG. 2 as 20. As can be seen, the extendable blade 20 is generally L-shaped, and includes a short leg 21 and a long leg 22. In the preferred embodiment, the angle between the short leg 21 and the long leg 22 is more than 90°. Long leg 22 has sharpened razor edge 23 along the outside edge of the L-shape. Razor edge 23 may also be serrated. Short leg 21 includes a blunted engagement edge 24 and a radius 25. Long leg 22 terminates at an angled edge forming blade stop 26. Split pin hole 27 is located near the intersection of blade stop 26 and razor edge 23. As with broadhead blade 10, the extendable blades 20 can be made of any suitable material, but would be stainless steel in the preferred embodiment.

The arrowhead body of the invention can be seen in FIGS. 3, 3*a*, 4, and 4*a*. The arrowhead body is generally shown in these drawings as 30. The arrowhead body 30 includes a shaft end 31 and a head end 32. The arrowhead body 30 is generally tubular in shape and in the preferred embodiment would be made of a strong yet lightweight material such as aluminum. The arrowhead body 30 has a threaded portion 33 at the shaft end 31. This threaded portion 33 mates with a corresponding threaded receptacle on the arrow shaft, shown as 48 on FIG. 5. A bevel 34 on the distal end of the threaded portion 33 facilitates assembly of the arrowhead body 30 with the arrow shaft.

Continuing along the arrowhead body 30 toward the head end 32, the next section shown is a cylindrical shaft 35. Arrowhead seating surface 36 provides a flat surface for the arrowhead body 30 to bear securely against the arrow shaft 48 when the two are threaded together.

Figure 3B:
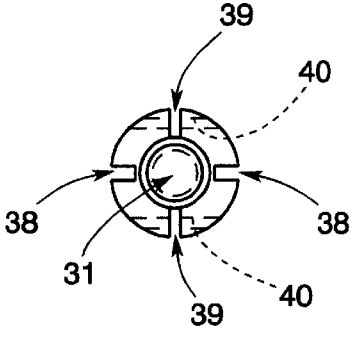
FIG. 3*b* is a sectional end view of the arrowhead body.
Figure 3A:
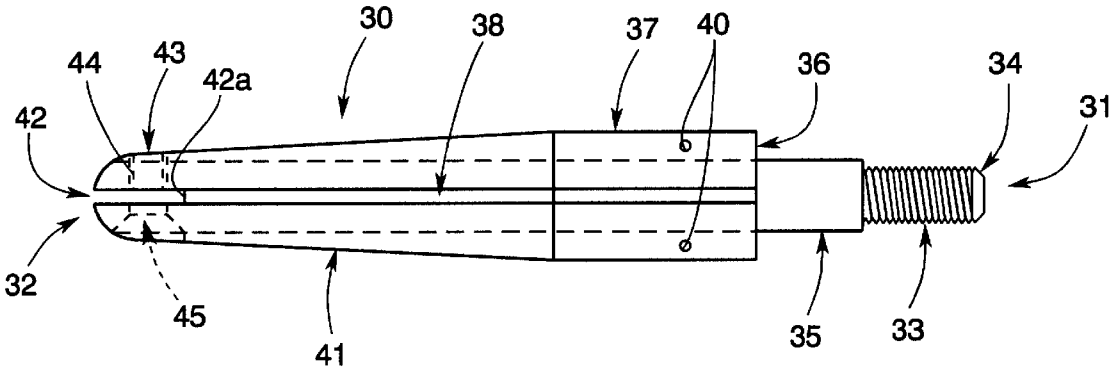
FIG. 3*a* is a sectional side view of the arrowhead body.
Figure 4A:
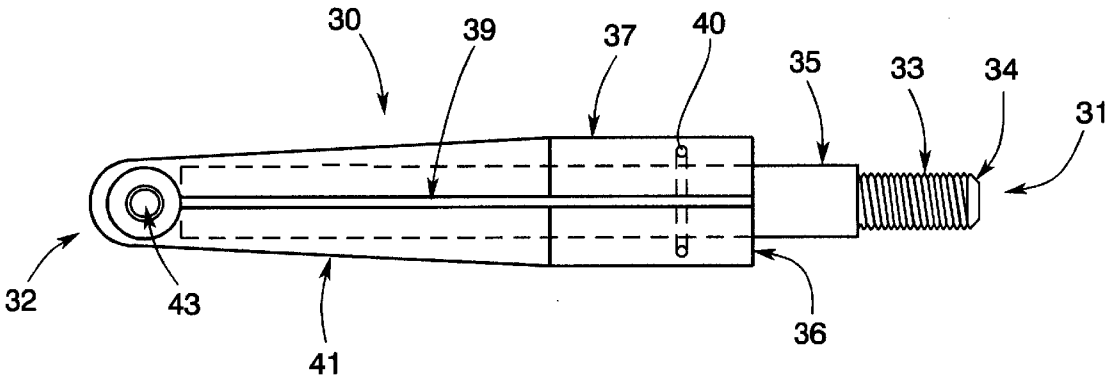
FIG. 4*a* is a sectional side view of the arrowhead body rotated 90° from FIG. 3.

Continuing along the arrowhead body 30 toward the head end 32, the next section shown is blade base 37. As best seen in FIGS. 3*a* and 4*a*, there are four longitudinal troughs cut into blade base 37, spaced at 90° intervals about its circumference. Two broadhead blade troughs 38 are spaced 180° apart. Two extendable blade troughs 39 are also spaced 180° apart, and 90° apart from broadhead blade troughs 38. Split pin holes 40 of a small diameter run through the blade base 37 and transversely intersect extendable blade troughs 39.

Continuing down the arrowhead body 30, the next section shown is the taper 41. Extendable blade troughs 39 continue running from the blade base 37 partially along the length of the taper 41. The exact total length of the extendable blade troughs 39 is not critical, but they must be at least as long as the long leg 22 of the extendable blade 20.

The head end 32 of the arrowhead body includes a cut 42 which is coplanar to the broadhead base troughs 38. The cut 42 terminates at cut bottom 42*a*. Broadhead blade screw hole 43 extends through the head end 32 and transversely intersects cut 42, with tapped section 44 lying on one side of cut 42 and flathead bore 45 on the other.

Figure 5:
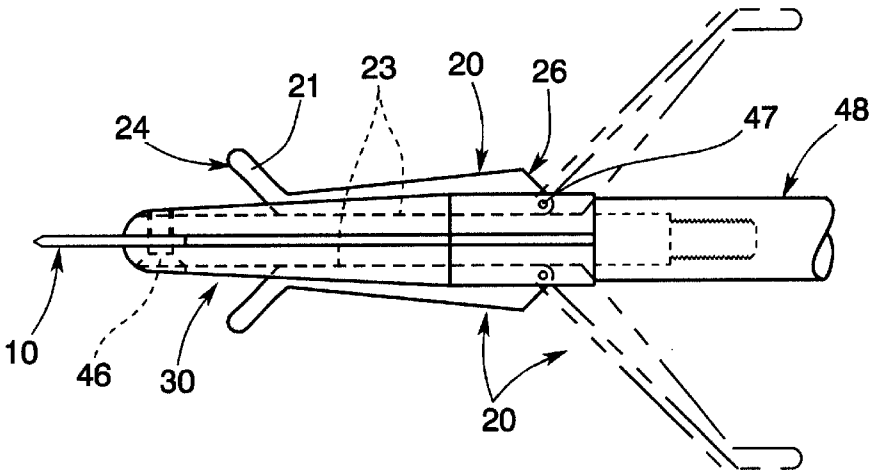
FIG. 5 is a sectional side view of the invention showing the extendable blades in both retracted and open positions.
Figure 6:
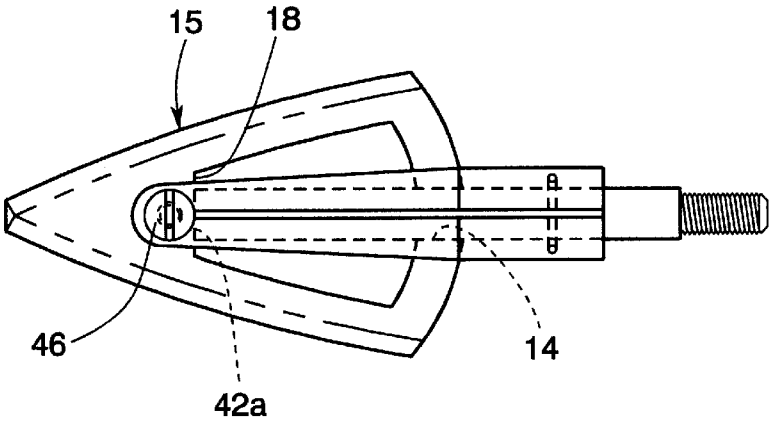
FIG. 6 is a sectional side view of the invention rotated 90° from FIG. 5.

Now that the various component parts of the invention have been described, it should be apparent how they are assembled, and reference is made to FIGS. 5 and 6. Broadhead blade 10 is slipped onto the arrowhead body 30 so that the following tabs 14 slide snugly into the broadhead base troughs 38 and the flat 18 butts up against cut bottom 42*a*. Following end gap 12*a* can be sized as necessary to provide a snug fit between the following tabs 14 and the broadhead base troughs 38. This brings the securing screw hole 16 on the broadhead blade 10 into alignment with the broadhead blade screw hole 43 of the arrowhead body 30. A blade screw 46 secures the broadhead blade 10 in place. Blade screw 46 can be removed to allow broadhead blade 10 to be easily removed and replaced.

A pair of extendable blades 20 is pivotally attached to the arrowhead body 30, each attached by a split pin 47 extending through one split pin hole 40 in the arrowhead body 30, through the split pin hole 27 in the extendable blade 20, and then through the opposing split pin hole 40 in the body 30. The ends of the split pins 47 can be crimped or flattened to prevent them from disengaging. The extendable blades 20 are thus oriented so that the razor edge 23 of each is within an extendable blade slot 39 when the long leg 22 of the extendable blade 20 is pressed against the body 30, while the short leg 21 protrudes from the body 30.

Since the extendable blades 20 are pivotably attached to the body 30, it can thus be seen that when the extendable blades 20 are in a retracted position force applied to the engagement edge 24 of the extendable blade 20 will cause the long leg 22 to pivot away from the body 30, exposing the razor edges 23. This will happen when the engagement edge 24 comes into contact with the target. The extention of the extendable blades 20 and provides substantial additional cutting surface in a radial plane perpendicular to the cutting surface of the broadhead razor edge 15. FIG. 5 demonstrates the retracted and open positions of the extendable blades 20. It can also be seen that the pivoting range of the extendable blades 20 is limited by blade stop 26. When blade stop 26 comes in contact with the arrowhead body 30, it prevents the extendable blade 20 from pivoting any further. It should be apparent that the angle of the blade stop 26 can be varied to cause the extendable blades 20 to stop pivoting at any desired point.

To secure the extendable blades 20 in a retracted position during shooting and flight, a rubber band or O-ring of suitable tension (not shown in the drawings) is placed around the extendable blades 20. This holds the blades 20 in retracted position until sufficient force is felt on the engagement edges 24 to overcome the resistance from the rubber band or O-ring.

Although the preferred embodiment of the invention has been described herein, it should be apparent to those skilled in the art that various changes and modifications may be made to the arrowhead of the invention without departing from its spirit and scope. This can include changes in material, size, dimension and angles.

What is claimed is:

1. A hunting arrowhead with one broadhead and two extendable blades for attachment to an arrow shaft, comprising:

(a) a generally tubular-shaped body with a tip end, a shaft end, and an outer surface, (b) four parallel, longitudinal and non-communicating troughs spaced at intervals about the outer surface of said body, thereby forming two pairs of opposed troughs, a first opposed pair and a second opposed pair, (c) a broadhead blade of approximately triangular shape including a pair of forward razor edges intersecting at a point, and a trailing edge with a gap at the mid-point of said trailing edge, (d) a pair of extendable blades, each being generally L-shaped with a shorter leg, a longer leg, said longer leg including a razor edge along the edge corresponding to the outside of the L-shape, and a pivot hole near a distal end of the longer leg, (e) securing means for securing said broadhead blade to said body, (f) pivotal attachment means for pivotally attaching each said extendable blade to said body, (g) an elastic retaining ring, (h) said broadhead blade attached to said body by slidably disposing the trailing edge into said first opposed pair of troughs and securing it in position by said securing means, (i) each said extendable blade attached to said body by said pivot attachment means such that said extendable blades can pivot from a retracted position to an open position, and further orienting each said extendable blade such that in said retracted position said razor edge of said longer leg is disposed by itself within one of said troughs in said second opposed pair, and said shorter leg is toward said tip end and protruding out from said body, while in said open position said shorter leg is toward said shaft end, said razor edge is without said trough, and the distal end of said longer leg bears against said body and limits the pivotal travel of said extendable blade, (j) said elastic retaining ring secured around said body and said extendable blades to hold them in said retracted position until said hunting arrowhead strikes a target.

2. The hunting arrowhead of claim 1 wherein the pivotal attachment means comprises the combination of split pin holes transecting each trough in said second opposed pair of troughs and a split pin for each said trough.

3. The hunting arrowhead of claim 1 wherein said broadhead blade includes a flattened or chisel tip at the intersection of said forward razor edges, and where said forward razor edges and said trailing edge are convex.

4. The hunting arrowhead of claim 1 wherein said shaft end includes a threaded fitting for threaded attachment to an arrow shaft.

5. The hunting arrowhead of claim 1 wherein an angle between said shorter lege and said longer leg in each extendable blade is greater than 90°.

6. The hunting arrowhead of claim 1 wherein said longer leg of said extendable blade is tapered and widest at said distal end.

7. The hunting arrowhead of claim 1 wherein said top end is split coplanar to said first opposed pair of troughs and includes a tapped section on one side of said split and a corresponding flat head bore on the other side of said split, such that when said broadhead blade is slidably disposed into said first opposed pair of troughs it also passes through said split.

* * * * *